US010113520B2

(12) United States Patent
Hamzeh et al.

(10) Patent No.: US 10,113,520 B2
(45) Date of Patent: Oct. 30, 2018

(54) INTAKE MANIFOLD RETENTION BRACKET FOR LONG-SHORT RUNNER CONTROL

(71) Applicant: FORD GLOBAL TECHNOLOGIES, LLC, Dearborn, MI (US)

(72) Inventors: Mike Hamzeh, Flat Rock, MI (US); Christopher William Newman, Farmington Hills, MI (US); Katherine Jane Brewer, Belleville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 510 days.

(21) Appl. No.: 14/847,046

(22) Filed: Sep. 8, 2015

(65) Prior Publication Data

US 2017/0067421 A1 Mar. 9, 2017

(51) Int. Cl.
*F02M 35/10* (2006.01)
*F02M 35/104* (2006.01)

(52) U.S. Cl.
CPC ..... *F02M 35/104* (2013.01)

(58) Field of Classification Search
CPC . F02M 35/104; F02M 35/1034; F02M 35/116
See application file for complete search history.

(56) References Cited

U.S. PATENT DOCUMENTS

| | | | | |
|---|---|---|---|---|
| 6,543,413 | B2 | 4/2003 | Lozen et al. | |
| 7,434,559 | B2 | 10/2008 | Park | |
| 8,015,958 | B2 | 9/2011 | Vichinsky et al. | |
| 8,191,526 | B2 | 6/2012 | Goldin et al. | |
| 2008/0190683 | A1* | 8/2008 | Hoeve | B60K 13/06 180/229 |

* cited by examiner

*Primary Examiner* — Hung Q Nguyen
(74) *Attorney, Agent, or Firm* — LeClairRyan

(57) ABSTRACT

A positioning bracket or a retention bracket to position an actuating arm connected to and at least partially external of an intake manifold, where the positioning bracket includes a body portion to receive there-through a fastener, and an ear portion extending from the body portion and defining an ear aperture to receive there-though a pin of the actuating arm.

20 Claims, 4 Drawing Sheets

INTAKE MANIFOLD RETENTION BRACKET FOR LONG-SHORT RUNNER CONTROL

TECHNICAL FIELD

The present invention relates to an intake manifold retention bracket and an intake manifold employing the same.

BACKGROUND

Vehicle internal combustion engines are often provided with an intake manifold to control air flow to the engine. In certain vehicle designs, the intake manifold may be equipped with a rotatable control valve to control the air flow into the intake manifold.

For instance, U.S. Pat. No. 8,191,526 discloses an intake manifold with flaps supported on a shaft, where grooves and bushing carriers may be engaged to each other to allow for segmentation of each of the flaps.

For instance also, U.S. Pat. No. 8,015,958 discloses an intake manifold flap cartridge assembly including flap valves positioned for short track communication and flap valves positioned for long track communication.

Yet for instance also, U.S. Pat. No. 7,434,559 discloses a retainer to support a valve shaft, where the retainer is so configured that locking bolts have their bolt ends each positioned among a folk part, a stop part and a pair of stop protrusions, and therefore are each prevented from unwanted removal from the intake manifold and entry into a combustion chamber.

Yet for instance also, U.S. Pat. No. 6,543,413 discloses a valve plate for securement to a shaft of an intake member of an engine, where the valve plate includes a tab and a resilient clip portion to help secure the valve plate relative to the shaft.

SUMMARY

In one or more embodiments, a positioning bracket is provided to position an actuating arm connected to and at least partially external of an intake manifold, the positioning bracket including a body portion to receive therethrough a fastener, and an ear portion extending from the body portion and defining an ear aperture to receive therethrough a pin of the actuating arm.

The body aperture may include first and second body apertures spaced apart from each other.

The ear aperture may differ from at least one of the first and second body apertures in aperture opening dimension.

The first and second body apertures may be positioned at an engagement position to sandwich therebetween a shaft of the intake manifold along a width direction.

The body portion may further include a middle aperture positioned between the first and second body apertures along a width direction.

The middle aperture may differ from at least one of the first and second body apertures in aperture opening dimension.

The ear aperture may differ in depth from at least one of the first and second body apertures.

The ear aperture may include first and second ear apertures spaced apart from each other.

The body portion and the ear portion may be integral in material.

At least one of the body and ear portions may include a polymer.

The ear aperture may be non-rotational in cross-sectional shape.

In another or more embodiments, an intake manifold is provided to include a housing including a shaft aperture, a shaft, a bracket adaptor including first and second fastener portions and a shaft portion positioned therebetween, the shaft portion being partially received through the shaft aperture, an actuating arm including a pin end, a shaft end and a main arm positioned between the pin end and the shaft end, the shaft end being received through the shaft aperture, and a positioning bracket including a body portion and an ear portion extending from the body portion, the body portion defining first and second body apertures to correspond to the first and second fastener portions of the bracket adaptor, and the ear portion including an ear aperture to receive therethrough the pin end of the actuating arm.

The shaft portion may be positioned between the shaft aperture and the shaft end along a width direction. The shaft end may be positioned between the shaft and the shaft portion along the width direction. The pin end and the shaft end of the actuating arm may extend away from the main arm in opposite directions.

One or more advantageous features as described herein are believed to be readily apparent from the following detailed description of one or more embodiments when taken in connection with the accompanying drawings.

BRIEF DESCRIPTION OF THE DRAWINGS

Reference is now made to the one or more embodiments illustrated in greater detail in the accompanying drawings and described below wherein.

DETAILED DESCRIPTION OF ONE OR MORE EMBODIMENTS

Figure 1:
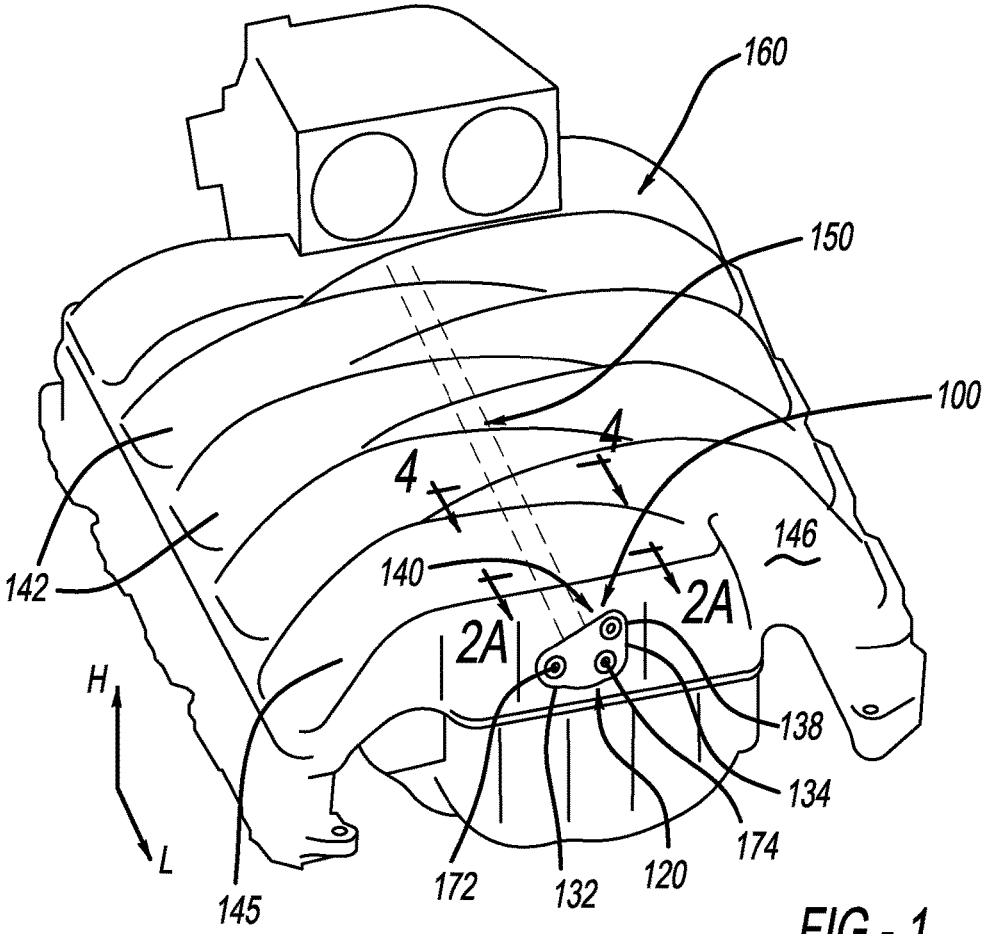
FIG. 1 illustratively depicts a perspective view of a positioning bracket as positioned on an intake manifold.

As referenced in the figures, the same reference numerals may be used herein to refer to the same parameters and components or their similar modifications and alternatives. These parameters and components are included as examples and are not meant to be limiting. The drawings referenced herein are schematic and associated views thereof are not necessarily drawn to scale.

The present inventive concept in one or more embodiments is directed to a positioning bracket or a retention bracket to position an actuating arm which is connected to and being at least partially external of an inlet manifold. In particular, the positioning bracket may be employed to lock the actuating arm to a "fixed" position such that air intake may be maintained at a pre-determined rate of flow. This positioning bracket is particularly beneficial for certain engine types and/or operational conditions where real-time alteration of air intake flow is not desired or recommended, and where a changeable position previously realized with an actuator motor may need to be avoided.

With this change, the actuator motor may be readily removed from these inlet manifolds, the actuator arm previously employed to link the shaft and the actuator motor may be positioned with the newly designed positioning bracket. This design is beneficial in that the actuator motor may be removed to deliver a substantial cost savings, while other existing design parameters specific to these inlet manifolds may continue to be used without substantial design variations and hence any additional cost. In addition, the positioning bracket may readily be removed and the actuator motor may be added back on if such a need arises, and an increased level of versatility, may favorably result.

Figure 2A:
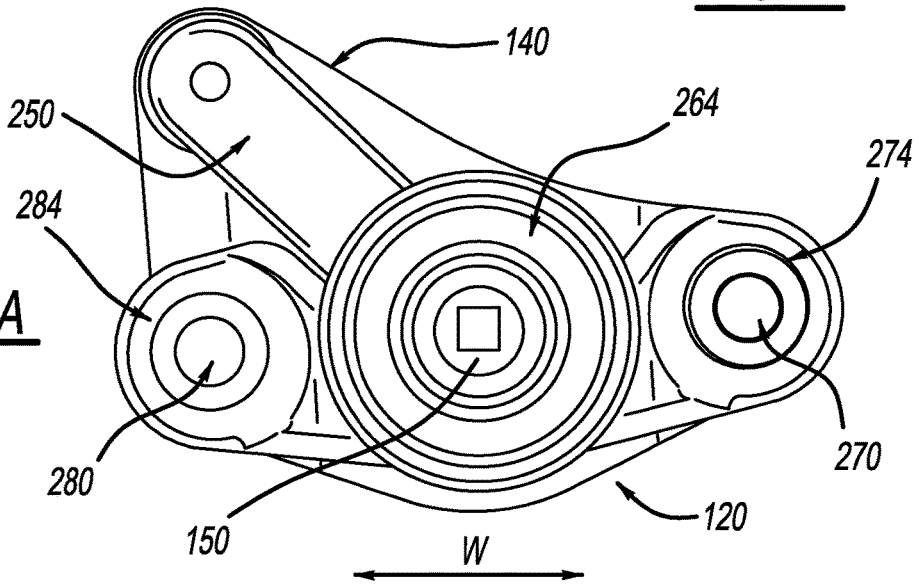
FIG. 2A illustratively depicts a view of the positioning bracket taken from inside of the inlet manifold referenced in FIG. 1.
Figure 2B:
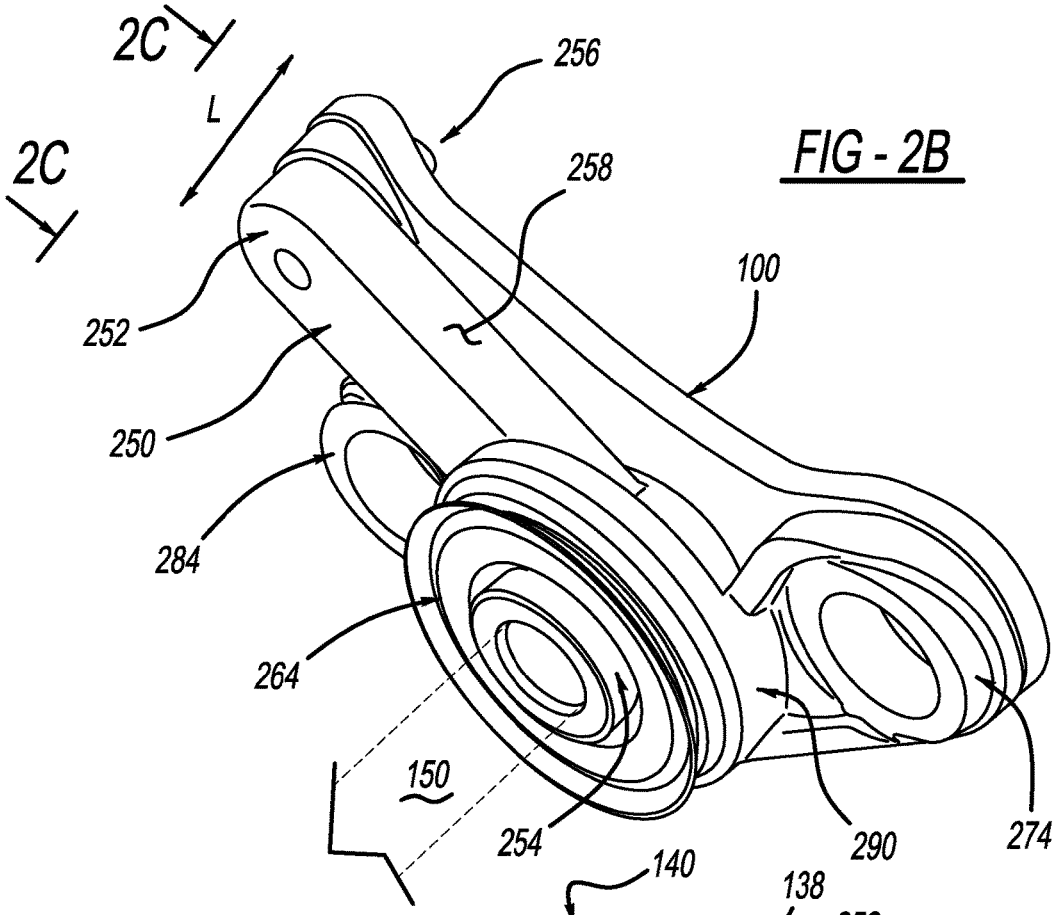
FIG. 2B illustratively depicts another alternative view of the positioning bracket referenced in FIG. 1.
Figure 2C:
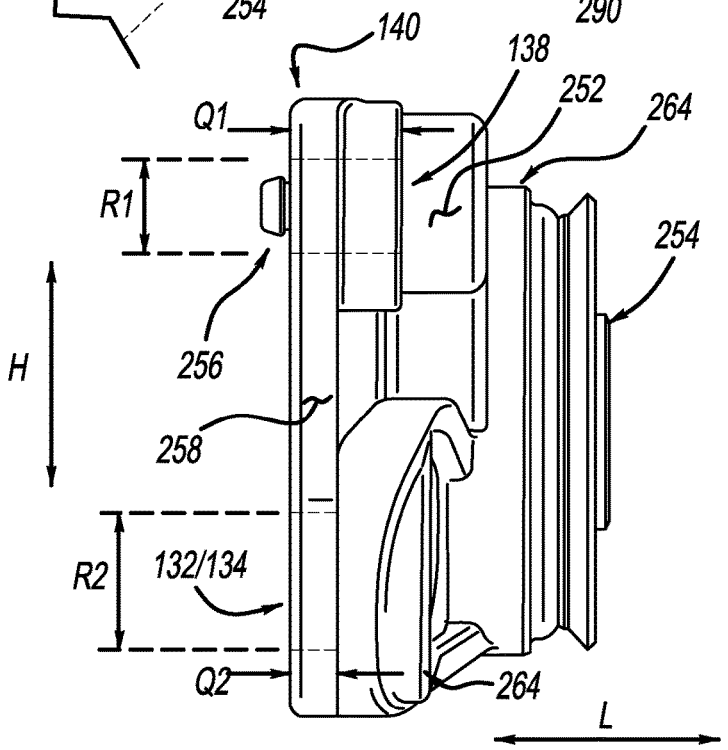
FIG. 2C illustratively depicts yet another alternative view of the positioning bracket referenced in FIG. 1.

In one or more embodiments, and in view of FIG. 1 through FIG. 2C, a positioning bracket 100 is provided to position an actuating arm 250 connected to and being at least partially external of an intake manifold 160, where the positioning bracket 100 includes a body portion 120 and an ear portion 140, the body portion 120 defining first and second body apertures 132, 134 to receive therethrough first and second fasteners 172, 174, and the ear portion 140 extends from the body portion 120 and defines an ear aperture 138 to receive therethrough a pin 256 of the actuating arm 250. The first and second body apertures 132, 134, alone or in combination, may be collectively referred to as a body aperture.

The intake manifold 160 may be of any suitable form and shape. In certain embodiments, and as illustratively depicted in FIG. 1, the intake manifold 160 may include a number of long/short runner control runners 142 which, along with a shaft 150, are positioned to control air flow into and out from the intake manifold 160. The intake manifold 160 may alternatively be termed the LSRC (long-short-runner-control) type of intake manifold. The shaft 150 may extend out of an external surface 146 of a housing wall 145 of the intake manifold 140 such that the shaft 150 is well supported on the housing wall 145.

Referring back to FIG. 2A and further in view of FIG. 2B and FIG. 2C, the actuating arm 250 may be employed to facilitate the movement of the shaft 150 and to control the extent of that movement. The actuating arm 250 may include a pin end 252, a shaft end 254, and a main arm 258 positioned therebetween, where the shaft end 254 is to receive a portion of the shaft 150. In particular, the shaft end 254 may be attached to the shaft 150 such that the shaft 150 moves with the shaft end 254, which in turn moves with the main arm 258. The pin 256 is located at the pin end 252 of the actuating arm 250 and is to be partially received through the ear aperture 138.

Referring back to FIG. 2A and further in view of FIG. 2B and FIG. 2C, the actuating arm 250 may be partially positioned between a bracket adaptor 290 and the positioning bracket 100 along a longitudinal direction L. The bracket adaptor 290 may include first and second fastener portions 274, 284, defining thereon first and second fastener apertures 270, 280, which are in turn to receive first and second fasteners 172, 174, respectively. The bracket adaptor 290 may further include a shaft portion 264 positioned between the first and second fastener portions 274, 284 along a width or transverse direction W. In function, the bracket adaptor 290 works to provide an area of contact for the actuating arm 250 such that the actuating arm 250 may work to cause the shaft 150 to rotate and change positions as desirable.

Although both of the first and second body apertures 132, 134 are shown present on the positioning bracket 100, only one but not both may be present in certain embodiments. As mentioned herein elsewhere, the positioning bracket 100 is particularly designed to at least temporarily hold the actuating arm 250 at a pre-determined position via which the shaft 150 is accordingly set at a corresponding position at which the air intake is suitable and/or desirable for the engine model and/or the operating conditions. Therefore, the positioning bracket 100 may be secured onto the intake manifold 160 via at least one of the first and second fasteners 172, 174, respectively through the first and second body apertures 132, 134, while the actuating arm 150 is held at its position via engagement to the ear aperture 138 of the positioning bracket 100.

Moreover, the positioning device 100 may be of any suitable shape as long as the objective of the actuating arm 250 be at least temporarily be held at a given position, and is not limited to the shape illustratively depicted in the drawings referenced herein. The shape as illustratively depicted in the drawings referenced herein, such as the shape shown in FIG. 1 and FIG. 2A through FIG. 2C may be particularly suitable for want of desirable mechanical strength parameters and total weight minimization.

Figure 3A:
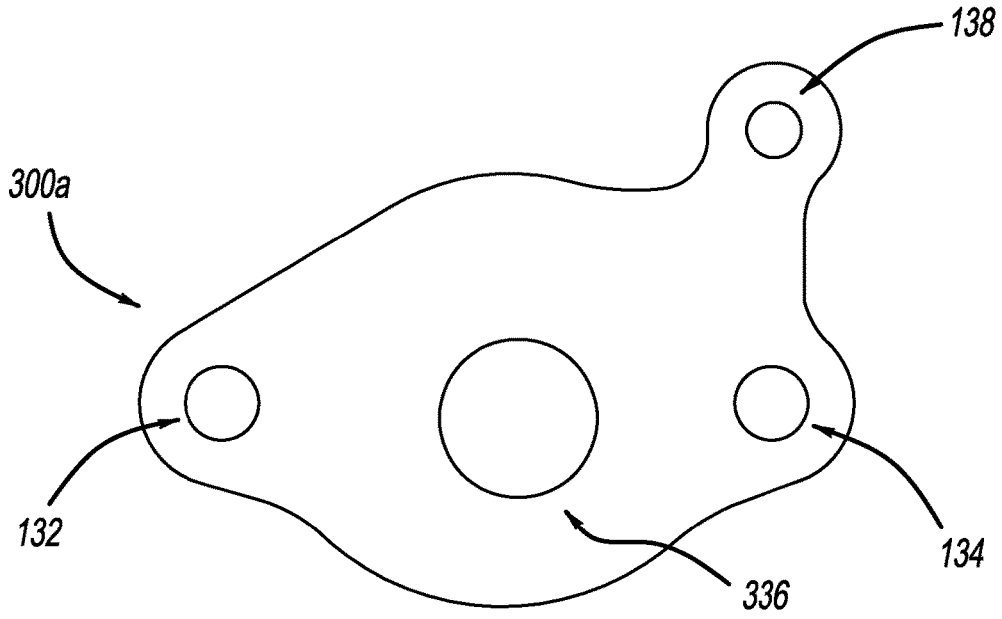
FIG. 3A illustratively depicts a frontal view of an alternative design to the positioning bracket referenced in FIG. 1.

In certain embodiments, and as illustratively depicted in FIG. 3A, an alternative view of the positioning bracket 100 is shown at 300*a*, which includes a middle aperture 336 positioned between first and second body apertures 132, 134 along direction W. This configuration may be particularly beneficial to provide enhanced stabilization of the actuating, arm 250, when another end (not shown) of the actuating arm 250 that is opposing the shaft end 254 may be received into and/or through the middle aperture 336 at an engagement position where certain positioning of the actuating arm 250 is retained.

Figure 3B:
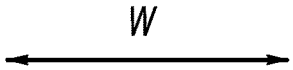
FIG. 3B illustratively depicts another frontal view of an alternative design to the positioning bracket referenced in FIG. 1.
Figure 3B:
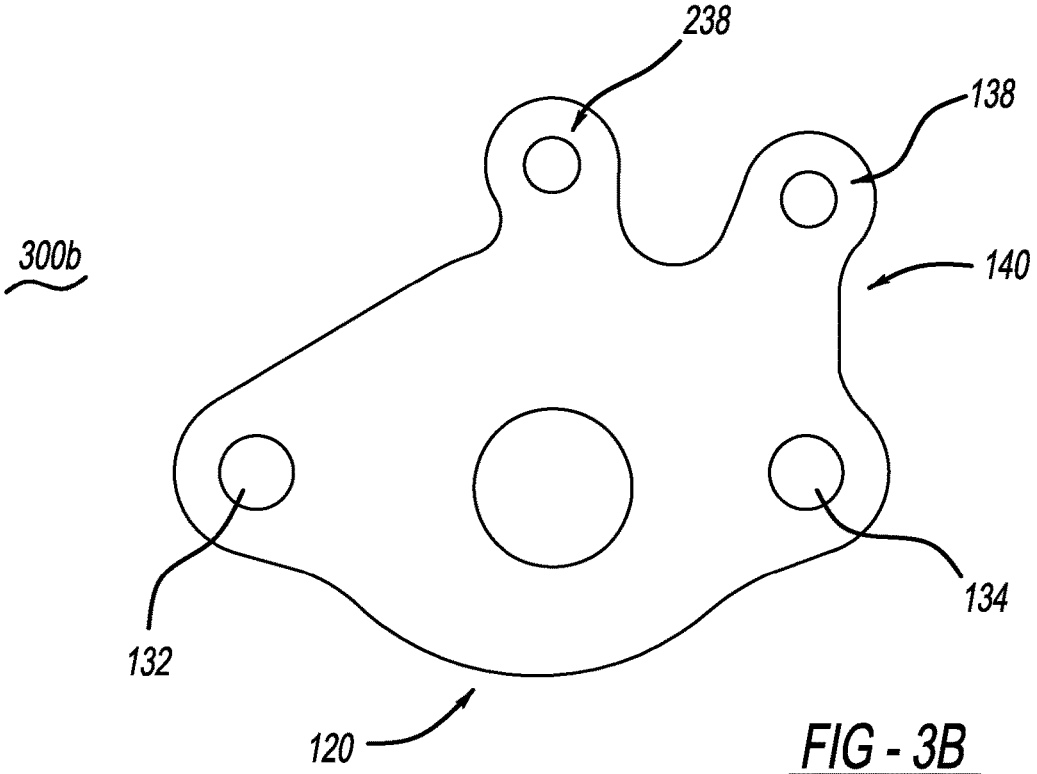

In certain other embodiments, and as illustratively depicted in FIG. 3B, yet another alternative design to the positioning device 100 is shown at 300*b*, where a second or more ear aperture 238 is included in the ear portion 140, in addition to the ear aperture 138 referenced in FIG. 1. This configuration is believed to be beneficial in providing more than one holding positioning for the actuating arm 250 and hence the shaft 150, when an alternative shaft position alternation may become desirable.

Figure 4:
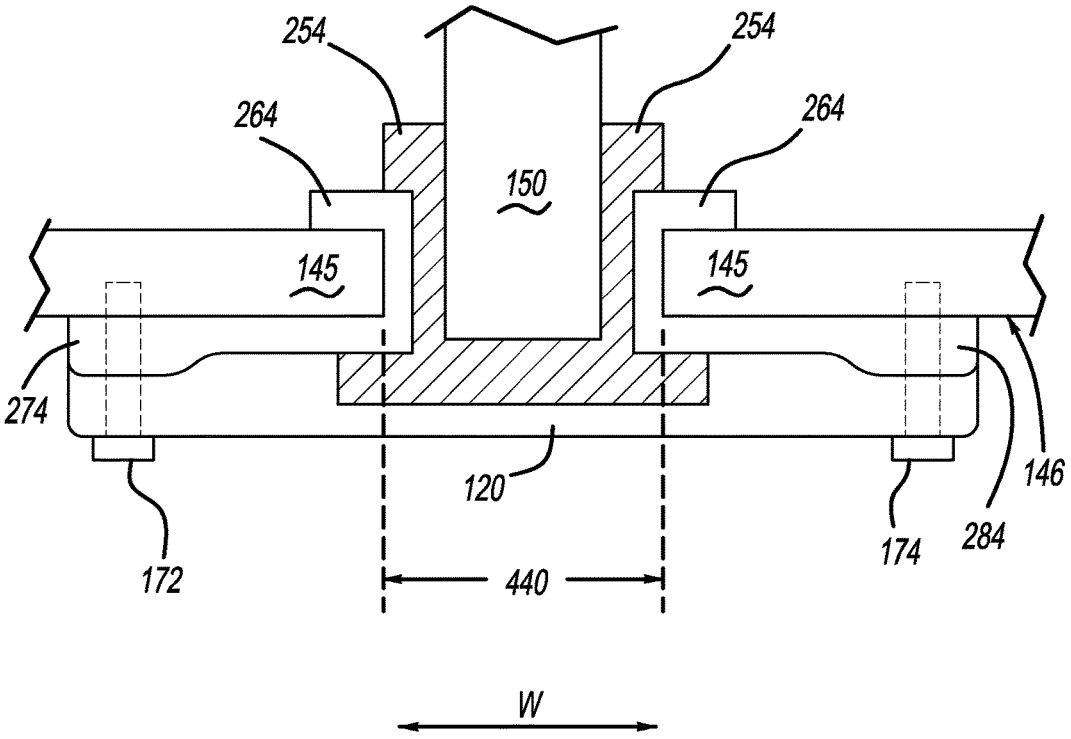
FIG. 4 illustratively depicts a partial cross-sectional view of the intake manifold referenced in FIG. 1.

In certain embodiments, and further in view of FIG. 4, the shaft portion 264 may be partially positioned between a shaft aperture 440 and the shaft end 254 of the actuating arm 250 along the width direction W at an engagement position. In turn, the shaft end 254 may also be positioned between the shaft 150 and the shaft portion 264 along width direction W at the engagement position.

The first and second fastener portions 274, 284 and the shaft portion 264 may be formed integral to one another to deliver additional labor and cost benefits. However, and in some other embodiments, any of the first and second fastener portions 274, 284 and the shaft portion 264 may be of a different material relative to one another and/or may be pre-formed and subsequently assembled. The first and second fastener portions 274, 284 and the shaft portion 264 may each independently be of any suitable material, with non-limiting examples thereof including metals, plastics, polymers and graphite.

Similarly, the body portion 120 and the ear portion 140 of the positioning bracket 100 may be integral in material. This may be achieved by forming the body portion 120 and the ear portion 140 together via processes of molding such as injection molding, such that the positioning bracket 100 is formed as a one-piece construction presenting material continuity between the body portion 120 and the ear portion 140. The body portion 120 and the ear portion 140 may each independently be of any suitable material, with non-limiting examples thereof including metals, plastics, polymers and graphite.

In certain embodiments, the ear aperture 138, 238 differs in aperture opening dimension and/or depth or thickness dimension from at least one of the first and second body apertures 132, 134. For instance, and further in view of FIG. 2C, the ear aperture 138, 238 as defined on the ear portion 140 may be of an aperture opening dimension R1 that is smaller than an aperture opening dimension R2 of the first or second aperture 132, 134 along height direction H. For instance also, and as illustratively depicted in FIG. 2C, the ear aperture 138, 238 as defined on the ear portion 140 may be of a depth or thickness dimension Q1 that is greater than a depth or thickness dimension Q2 of the first or second body aperture 132, 134. With relatively greater depth dimension and smaller aperture opening dimension, the ear aperture 138, 238 is believed to help retain the actuating arm 150 with greater ease and strength.

In certain embodiments, the ear aperture 138, 238 may differ in cross-section dimension from at least one of the first and second body apertures 132, 134. For instance, while the first and second body apertures 132, 134 may be shaped as a circle or an oval to respectively accommodate the first and second fasteners 172, 174, the ear aperture 138 may be of a non-rotational shape such as a rectangle, a square or any other suitable shapes. Such non-rotational shapes are believed to impart additional positioning effect onto the positioning bracket 100 such that the actuating arm 250 may be snuggly secured in position via its pin 256 relative to the ear aperture 138, 238 of the positioning bracket 100.

In one or more embodiments, the present invention as set forth herein provides a positioning bracket to position an actuating arm employed in intake manifold operations. However, one skilled in the art will readily recognize from such discussion, and from the accompanying drawings and claims that various changes, modifications and variations can be made therein without departing from the true spirit and fair scope of the invention as defined by the following claims.

What is claimed is:

1. An apparatus for rotating a shaft extending through an intake manifold, comprising:

a bracket adaptor including a fastener portion and a shaft portion;

an actuating arm including a pin end, a shaft end, and a main arm positioned between the pin end and the shaft end, the shaft end receiving a portion of the shaft and extending into the shaft portion of the bracket adapter; and a positioning bracket including a body portion and an ear portion extending from the body portion, the body portion defining a body aperture to interface the fastener portion of the bracket adaptor, and the ear portion including an ear aperture to receive partially therethrough a pin at the pin end of the actuating arm.

2. The apparatus of claim 1, wherein the body aperture includes first and second body apertures spaced apart from each other.

3. The apparatus of claim 2, wherein the ear aperture differs from at least one of the first and second body apertures in an aperture opening dimension.

4. The apparatus of claim 2, wherein the first and second body apertures are positioned at an engagement position to sandwich therebetween the shaft of the intake manifold along a width direction.

5. The apparatus of claim 2, wherein the body portion further includes a middle aperture positioned between the first and second body apertures along a width direction.

6. The apparatus of claim 5, wherein the middle aperture differs from at least one of the first and second body apertures in an aperture opening dimension.

7. The apparatus of claim 2, wherein the ear aperture differs in depth from at least one of the first and second body apertures.

8. The apparatus of claim 2, wherein the ear aperture includes first and second ear apertures spaced apart from each other.

9. The apparatus of claim 1, wherein the body portion and the ear portion are integral in material.

10. The apparatus of claim 1, wherein at least one of the body portion and the ear portion includes a polymer.

11. The apparatus of claim 1, wherein the ear aperture is non-rotational in cross-sectional shape.

12. An intake manifold comprising:

a housing defining a shaft aperture;

a shaft supported on the housing;

a bracket adaptor including first and second fastener portions and a shaft portion positioned therebetween, the shaft portion being partially received through the shaft aperture;

an actuating arm including a pin end, a shaft end and a main arm positioned between the pin end and the shaft end, the shaft end being received through the shaft aperture; and a positioning bracket including a body portion and an ear portion extending from the body portion, the body portion defining first and second body apertures to interface the first and second fastener portions of the bracket adaptor, and the ear portion including an ear aperture to receive partially therethrough a pin at the pin end of the actuating arm.

13. The intake manifold of claim 12, wherein the shaft portion is positioned between a housing wall defining the shaft aperture and the shaft end of the actuating arm along a width direction.

14. The intake manifold of claim 13, wherein the shaft end is positioned between the shaft and the shaft portion along the width direction.

15. The intake manifold of claim 12, wherein the pin end and the shaft end of the actuating arm extend away from the main arm in opposite directions.

16. The intake manifold of claim 12, wherein the body portion and the ear portion are integrally formed.

17. The intake manifold of claim 12, wherein the ear aperture differs in at least one of aperture depth and aperture opening dimension from at least one of the first and second body apertures.

18. The intake manifold of claim 12, wherein at least one of the body and ear portions includes a polymer.

19. The intake manifold of claim 12, wherein the positioning bracket further includes a middle aperture positioned between the first and second body apertures along a width direction and to receive partially therethrough the shaft end of the actuating arm.

20. A method of operating an intake manifold, the intake manifold including a shaft and a housing with a shaft aperture, a bracket adaptor with first and second fastener portions and a shaft portion positioned therebetween, the shaft portion being partially received through the shaft aperture, and an actuating arm including a pin end, a shaft end and a main arm positioned between the pin end and the shaft end, the shaft end being received through the shaft aperture, the method comprising:

attaching a positioning bracket onto the actuating arm and the bracket adaptor, the positioning bracket including a body portion and an ear portion extending from the body portion, where the body portion defines first and second body apertures to respectively interface the first and second fastener portions of the bracket adaptor, and the ear portion includes an ear aperture to receive partially therethrough a pin at the pin end of the actuating arm.

* * * * *